US008702024B2

(12) United States Patent
Iafrate

(10) Patent No.: US 8,702,024 B2
(45) Date of Patent: Apr. 22, 2014

(54) ROLLER JAW CRUSHER SYSTEM AND METHOD

(75) Inventor: John A. Iafrate, Apopka, FL (US)

(73) Assignee: Apopka Recycling, Inc., Apopka, FL (US)

( * ) Notice: Subject to any disclaimer, the term of this patent is extended or adjusted under 35 U.S.C. 154(b) by 747 days.

(21) Appl. No.: 12/424,227

(22) Filed: Apr. 15, 2009

(65) Prior Publication Data

US 2009/0261188 A1 Oct. 22, 2009

Related U.S. Application Data

(60) Provisional application No. 61/045,481, filed on Apr. 16, 2008.

(51) Int. Cl.
*B02C 1/04* (2006.01)

(52) U.S. Cl.
USPC ..... 241/241.5; 241/266

(58) Field of Classification Search
USPC ..... 241/241.5, 266, 286, 290
See application file for complete search history.

(56) References Cited

U.S. PATENT DOCUMENTS

| | | | | |
|---|---|---|---|---|
| 2,582,734 | A | 1/1952 | Adams | |
| 2,588,180 | A | 3/1952 | Traylor, Jr. | |
| 3,063,648 | A | 11/1962 | Ossenbrink | |
| 3,229,922 | A | 1/1966 | Weiss et al. | |
| 3,503,563 | A | 3/1970 | Daly | |
| 3,608,841 | A | 9/1971 | Wageneder | |
| 4,165,042 | A * | 8/1979 | Peterson | 241/204 |
| 4,288,039 | A | 9/1981 | Waskow | |
| 4,592,516 | A | 6/1986 | Tschantz | |
| 4,749,136 | A * | 6/1988 | McConnell, Jr. | 241/266 |
| 4,838,493 | A | 6/1989 | LaBounty | |
| 4,838,494 | A * | 6/1989 | Jakobs | 241/226 |
| 4,899,942 | A * | 2/1990 | Bohringer | 241/200 |
| 4,951,886 | A | 8/1990 | Berto | |
| 5,248,100 | A | 9/1993 | Arakawa | |
| 5,255,860 | A | 10/1993 | Timmons | |
| 5,361,999 | A * | 11/1994 | Sakato et al. | 241/101.72 |
| 5,490,636 | A | 2/1996 | Schrodl | |
| 5,503,340 | A | 4/1996 | Doppstadt | |
| 5,881,959 | A | 3/1999 | Hadjinian et al. | |
| 5,887,810 | A | 3/1999 | Maruyama | |
| 6,827,301 | B1 * | 12/2004 | Kassuba | 241/37 |
| 7,278,596 | B2 | 10/2007 | Moriya et al. | |
| 7,344,097 | B2 | 3/2008 | Young et al. | |
| 2005/0006508 | A1 | 1/2005 | Roberts | |
| 2007/0029422 | A1 | 2/2007 | Niemela et al. | |

FOREIGN PATENT DOCUMENTS

| | | |
|---|---|---|
| AU | 4137878 | 5/1980 |
| CA | 1119573 | 3/1982 |
| GB | 578292 A | 6/1946 |
| GB | 1043787 | 9/1966 |
| JP | 1-139151 A | 5/1989 |
| JP | 11-47622 A | 2/1999 |

* cited by examiner

*Primary Examiner* — Mark Rosenbaum
(74) *Attorney, Agent, or Firm* — Terry M. Sanks, Esq.; Beusse Wolter Sanks Mora & Maire, P.A.

(57) ABSTRACT

A roller jaw crusher system including an elongated roller that rotates normally about a center axis, and a movable breaking plate configured to define a gradually smaller gap between the breaking plate and the roller, wherein the movable breaking plate is configured to rise upward and descend in both a downward direction and a direction toward the elongated roller to break a frangible material captured between the elongated roller and the movable breaking plate.

22 Claims, 3 Drawing Sheets

ROLLER JAW CRUSHER SYSTEM AND METHOD

This application claims the benefit of U.S. Provisional Application No. 61/045,481, filed Apr. 16, 2008.

FIELD OF THE INVENTION

The present invention relates to crushers and in particular to the type of crushers generally used to break concrete and rock into smaller size aggregate, including crushers used to comminute masses of reinforced concrete and asphalt taken from demolition sites and stone taken from quarries.

BACKGROUND OF THE INVENTION

Crushing devices are known in the art for use to reduce large pieces of frangible material, such as but not limited to concrete, rock, asphalt, etc., to smaller pieces. For the most part, jaw crushers now in use have proven to be satisfactory for most of their intended purposes including, feed size, hard rock capability, reduction ratio, product characteristics, throughput, and economy. However improvements in each of these areas are still possible. For example, prior art jaw-type crushers had a fixed jaw and a large heavy movable jaw. One improvement in the prior art provided for jaw-type crushers having eccentrically mounted rotatable rollers driven by motors where the frangible material would pass over at least one of the rollers. Since the frangible material was placed on at least one of the eccentrically mounted rotatable rollers, the motor driving the roller would have to produce sufficient force to allow the roller to produce its eccentric movement, even with the additional weight from the frangible material. Because of the added weight upon such rollers, this type of prior art jaw-type crusher could typically experience more wear and tear than crushers that didn't apply additional weight to an eccentrically mounted rotatable roller.

Therefore entities wishing to break frangible material into smaller pieces would benefit, by needing fewer replacement parts and less repair time associated with installing replacement parts or fixing a roller jaw crusher system, from having a roller jaw crusher system and method which provides for eccentric movement by an element within the crusher where the element is not weighted down with additional weight due to the frangible material passing over such the element. The same entities will realize additional benefits from a roller jaw crusher system that uses at least one of the eccentrically mounted rotatable rollers of the roller jaw crush system to crush the frangible material a first time and a second time, thus resulting in smaller pieces of the frangible material.

BRIEF DESCRIPTION OF THE INVENTION

Embodiments of the present invention relate to a system and method for providing a roller jaw crusher to break up frangible material. In an exemplary embodiment the roller jaw crusher system comprises an elongated roller that rotates normally about a center axis, and a movable breaking plate configured to define a gradually smaller gap between the breaking plate and the roller. The movable breaking plate is configured to rise upward and descend in both a downward direction and a direction toward the elongated roller to break a frangible material captured between the elongated roller and the movable breaking plate.

In another exemplary embodiment the roller jaw crusher system comprises a first roller that rotates normally about a center axis, and a second roller that rotates normally about a center axis. A movable breaking plate disposed between the first roller and the second roller is further included. The movable breaking plate has a front side facing the first roller and a back side facing the second roller where each side is configured to define a gradually smaller gap between the breaking plate and each respective roller. A conveyer system to deliver frangible material exiting from a first gradually smaller gap between the first roller and the movable breaking plate to a second gradually smaller gap between the breaking plate and the second roller is also included. Movement of the movable breaking plate results in breaking a frangible material disposed between the first roller and the movable breaking plate into broken pieces that are broken into smaller pieces when disposed between the second roller and the movable breaking plate.

The exemplary embodiment of the method for breaking frangible material comprises feeding the frangible material passed a roller that rotates normally about a center axis into an opening having a gradually smaller gap defined by the roller and a breaking plate, and eccentrically actuating the breaking plate to constrict the gradually smaller gap as the frangible material is passed therethrough.

Another exemplary embodiment of the method for breaking frangible material comprises feeding frangible material into a first opening having a gradually smaller gap defined by a roller and a front side of an eccentrically actuated breaking plate. The frangible material is transported from the first opening to a second opening having a gradually smaller gap defined by a second roller and a backside of the eccentrically actuated breaking plate. The frangible material is fed into the second opening. The breaking plate is eccentrically actuated to constrict the gradually smaller gap of the first opening and the second opening as the frangible material is passed therethrough each opening.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

Figure 1:
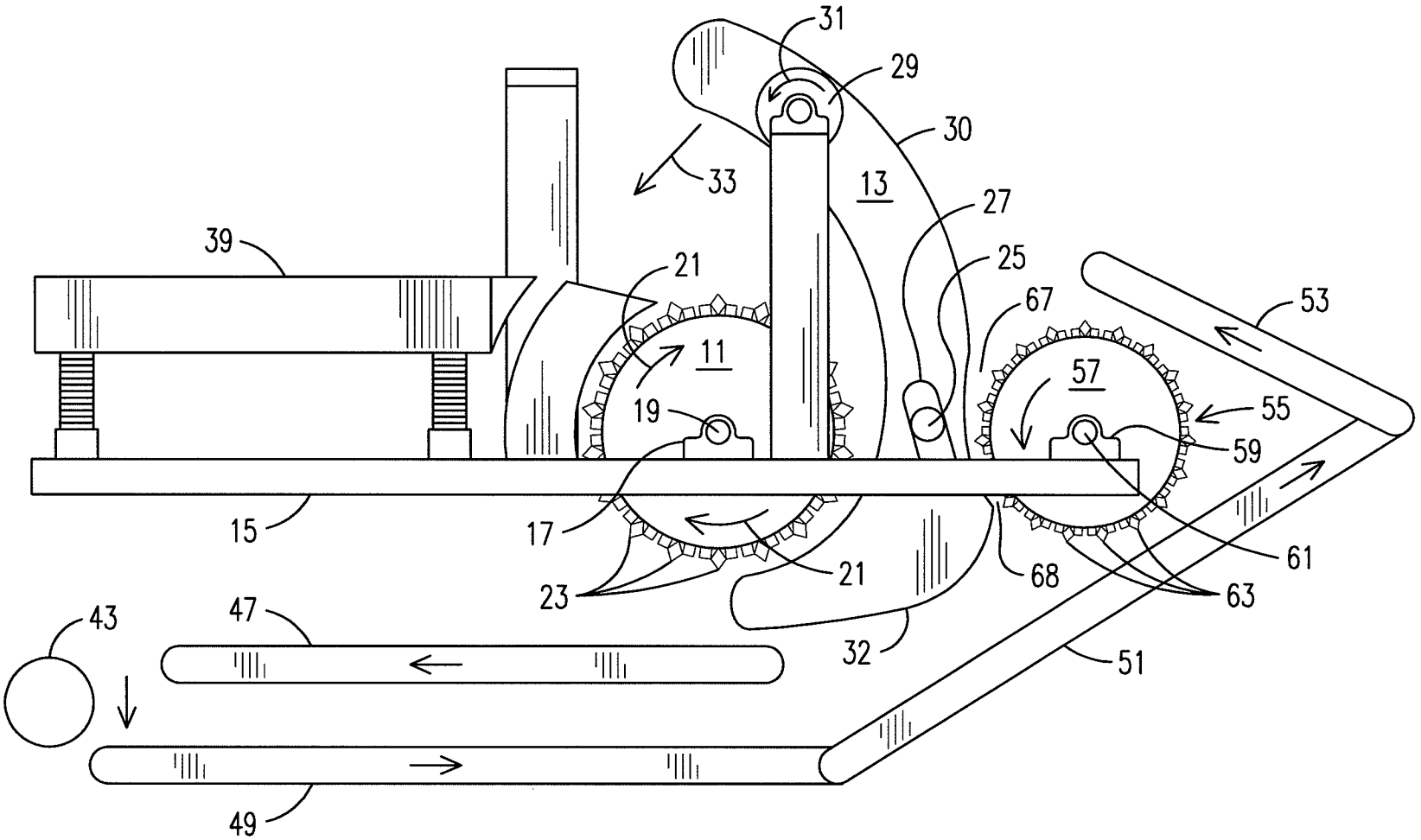
FIG. 1 discloses an end view of an exemplary embodiment of a roller-jaw crusher.

This invention uses a combination of a roller and a breaking plate to break elongated sections of frangible material into smaller pieces. Referring to FIG. 1, the main components of an exemplary embodiment of the invention are a roller 11 and a breaking plate 13. It will be recognized that FIG. 1 is merely an end view of an exemplary embodiment of the invention and that the roller 11 and plate 13 both extend into the plane of the paper. Thus, the roller 11 can be considered an elongated roller. In a typical application, it is expected that the roller 11 will have an axial length of about four feet and that the plate 13 will have the same dimension to match the roller. However, other axial lengths can be selected depending upon the particular use for the invention.

The roller 11 and plate 13 are supported on a frame member 15. A conventional bearing assembly 17 is attached to the frame member 15 and an axle 19 of roller 11 is mounted in the assembly 17. An identical arrangement for supporting the roller 11 for rotation is provided on an opposite end of the elongated roller. The roller 11 rotates normally about a center axis. More specifically, the rotation of the roller is not eccentric. In addition, a motor, not shown, is connected in driving relationship to the roller 11 to effect rotation of the roller in the direction indicated by arrows 21. In an exemplary embodiment, the motor is a hydraulic motor of about 100 hp and the roller 11 has a diameter of about 24 to 48 inches. The roller also may include a plurality of teeth 23 that catch and pull the frangible material and aid in breaking the material into smaller pieces.

The breaking plate 13 is mounted to the frame member 15 via a sliding connection at axle 25. The axle 25 is attached to frame member 15 using a bearing assembly (not shown) but similar to assembly 17. The plate is constructed with a slotted opening 27 through which axle 25 extends. This allows the plate 13 to pivot about axle 25 and also to move in a nearly-vertical direction transverse to the axial direction of the axle. Hence, the breaking plate may be considered a movable breaking plate. At an upper end of the plate 13 there is provided a driving connection arranged with a cam action so that the plate 13 moves in a chewing fashion toward and down onto any material that is pulled into the gap between the roller 11 and the plate. This motion may also be considered eccentric. More specifically, a cam roller 29 is fitted to plate 13 and rotates in the direction shown by arrows 31 to cause a top part 30 of the plate 13 to rise upward with a base or bottom part 32 of the plate guided by the slotted opening 27 on axle 25. The top part 30 of the plate 13 then descends in both a downward direction and a direction toward the roller 11 as shown by arrow 33 as to break slabs of material disposed between the roller 11 and plate 13. A bottom part 32 of the plate 13 descends in both a downward direction and a direction away from the roller 11. The cam roller 11 may be mounted on an eccentric drive to effect the desired cam action such as that used to effect linear motion of a piston in an internal combustion engine. The mechanical means of implementing such cam motion are well known in the art.

Figure 2:
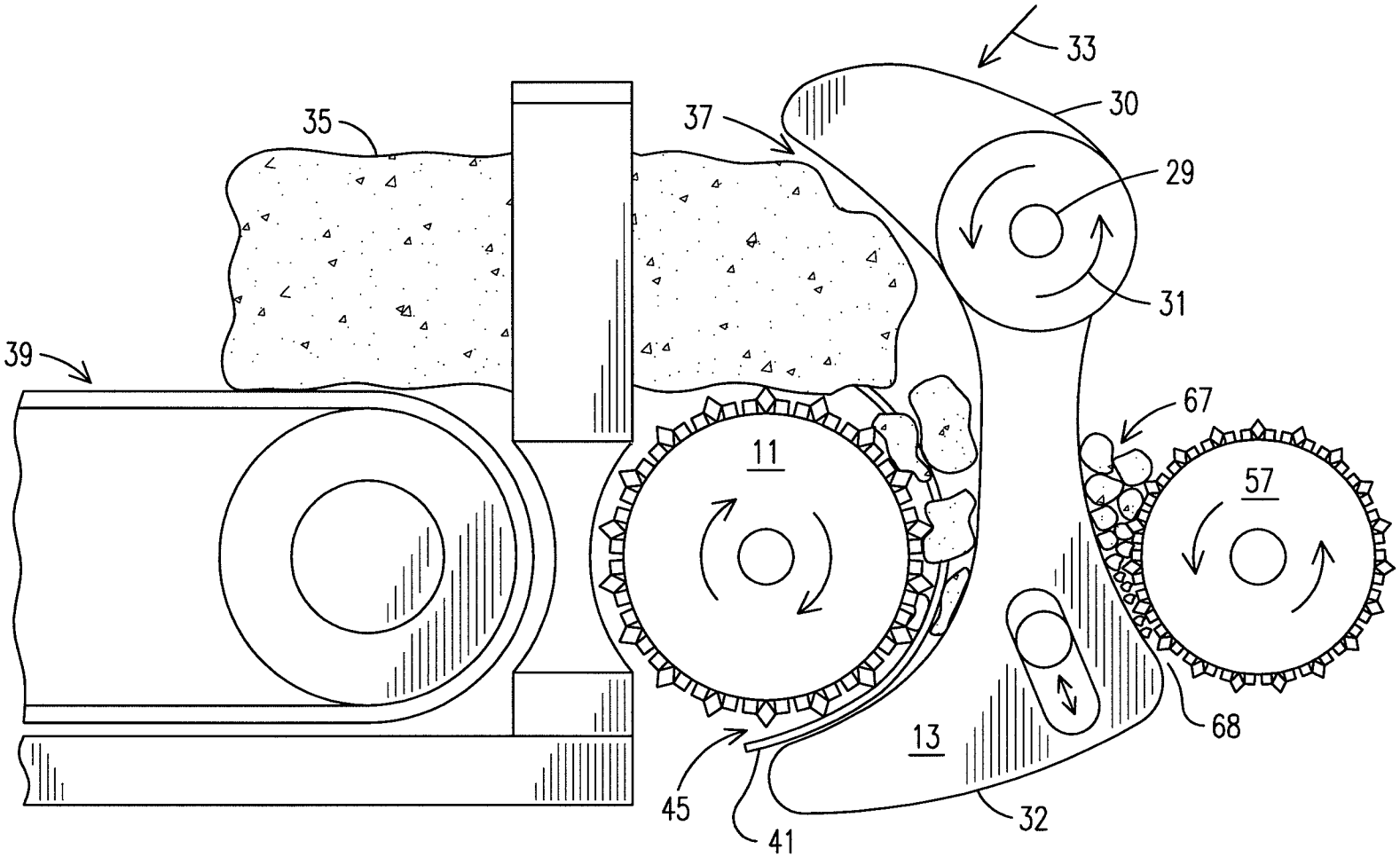
FIG. 2 discloses an end view of an exemplary embodiment of the roller-jaw crusher in operation.

As shown more clearly in FIG. 2, the concrete slab 35 is fed into the opening 37 between plate 13 and roller 11 and is broken up by the camming action of the plate 13. The broken pieces then fall into a space between the roller 11 and plate 13 and continue to be broken into smaller pieces by the teeth 23 (an exemplary embodiment disclosed in further detail in FIG. 3) on the roller 11 and the repeated camming action of the plate 13 against the roller 11. The feeder 39 may be a conventional conveyor belt feeder of a type well known in the art. It will be noted that reinforcing steel (rebar) that is in concrete slab 35 will feed, and/or pass, through the crusher as shown at 41 and can be collected using standard magnetic extractors such as that shown at 43 in FIG. 1.

It will be noted by reference to the drawings that the breaking plate 13 is shaped to define a gradually smaller gap between the plate 13 and roller 11 from the entrance opening at 37 and the exit spacing at 45. This arrangement allows the frangible material to be systematically broken into smaller and smaller pieces.

By way of example, in one form the breaking plate 13 may be about 18 inches thick by 4 feet in width by 8 feet in height and driven by a 200 hp hydraulic motor to provide the camming action and break the frangible material such as the concrete slab. The concrete pieces exiting the roller 11 are of varying sizes up to a maximum of about 8 to 10 inches. In FIG. 1, the pieces are depositing on a conveyor 47 and transported over a filter screen (not shown) that allows pieces of less than about two inches in size to drop to a collection area. Larger pieces travel to the end of conveyor 47 and fall onto a second conveyor 49, then to another conveyor 51 and onto still another conveyor 53 where the pieces are finally delivered to another crusher at 55. Though specific combinations of conveyor belts are disclosed, those skilled in the art will readily recognize that any delivery system of once broken frangible material may be utilized.

Additionally while a second crusher could be separate, in a preferred embodiment the second crusher 55 is formed by a back side of the breaking plate 13 and a second roller 57. In this embodiment, the second roller 57 is also rotationally mounted to member 15 via a bearing assembly 59 at one end of axle 61 and a second bearing assembly at another end of the axle 61. The second roller 57 may be of smaller diameter than the first roller 11 and have smaller teeth 63 to create smaller pieces. In one form, the teeth 63 on the second roller 57 are about 3/16 inch high and result in crushing the frangible material to about 3/8 inch. Note that the breaking plate 13 also has a camming, or eccentric, action against roller 57, more specifically to the space between the plate 13 and the second roller 57, to assist in the breaking of the material. In an exemplary embodiment, the backside of the plate 13 is shaped to define a gradually smaller gap between the backside of the plate 13 and roller 15 from an entrance opening at 67 and an exit spacing at 68. This arrangement allows the frangible material to be systematically broken into smaller and smaller pieces.

It should also be noted that the size of the crusher, either the first crusher which is formed by the roller 11 and a front of plate 13, or the second crusher 55 which is formed by the second roller 57 and backside of plate 13, can be of different sizes to accommodate different sizes of material. Further, the crusher can be a single stage using only the first roller 11 and the front of plate 13. The single stage crusher may be advantageously used in a portable crusher arrangement where the crusher material is loaded into a truck or other transport system for removal to another location.

Figure 3:
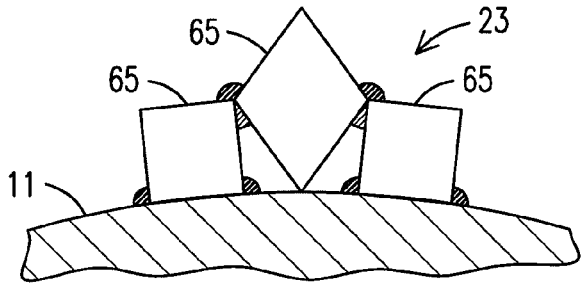
FIG. 3 discloses one type of tooth formation for teeth on a roller that is part of the roller-jaw crusher.

FIG. 3 illustrates one type of tooth formation for the teeth 23 of the roller 11. Each tooth 23 is formed from three elongated, square steel bars 65, each bar being about two inches on a side. Two bars 65 are welded to an outer surface of the roller 11 and spaced apart just enough to receive a third bar that is rotated so that opposite corners contact the first two bars. The third bar is then welded to the first two bars to form the elongate tooth 23. Preferably, a plurality of these teeth 23 is circumferentially distributed about the roller 11 on about one and three quarter inch spacing.

Figure 4:
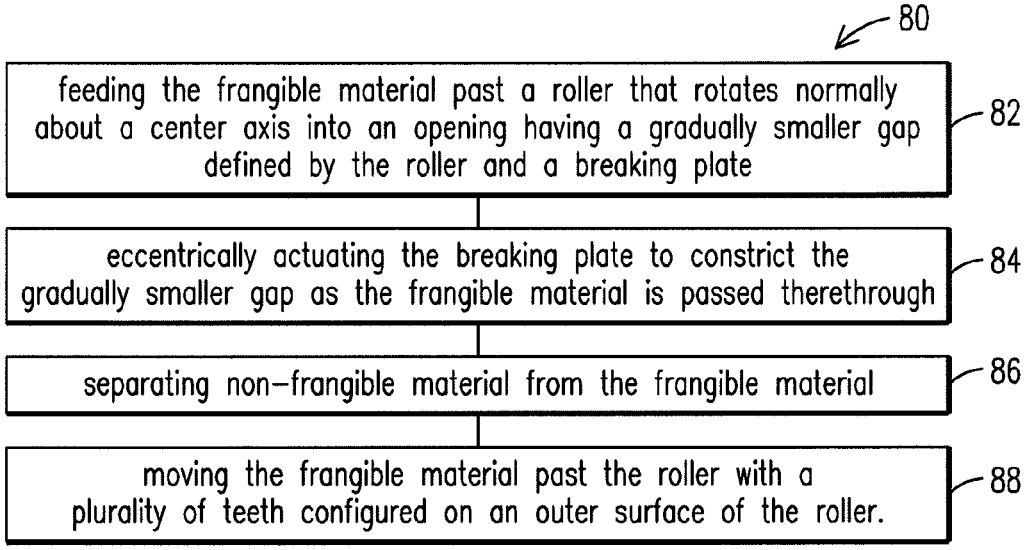
FIG. 4 discloses a flowchart illustrating an exemplary embodiment of a method for breaking frangible material.

FIG. 4 discloses a flowchart 80 illustrating an exemplary embodiment of a method for breaking frangible material. The method includes feeding the frangible material passed, around and/or over, a roller that rotates normally about a center axis into an opening having a gradually smaller gap defined by the roller and a breaking plate, at 82. The breaking plate is eccentrically actuated, or moved in an eccentric manner, or motion, such as disclosed above, to constrict the gradually smaller gap as the frangible material is passed therethrough, at 84. Eccentrically actuating the breaking plate causes the breaking plate to rise upward and descend in both a downward direction and a direction toward the elongated roller to break a frangible material captured between the elongated roller and movable the breaking plate. Non-frangible material, such as but not limited to rebar, is separated from the frangible material while the frangible material is being broken, at 86. The frangible material is fed, pulled, or passed, by the roller with a plurality of teeth configured on an outer surface of the roller, at 88. Those skilled in the art will recognize that utilizing this method, the frangible material is being transformed from larger pieces of material, such as but not limited to concrete slabs, into smaller pieces of material that may then be recycled for use in other products.

Figure 5:
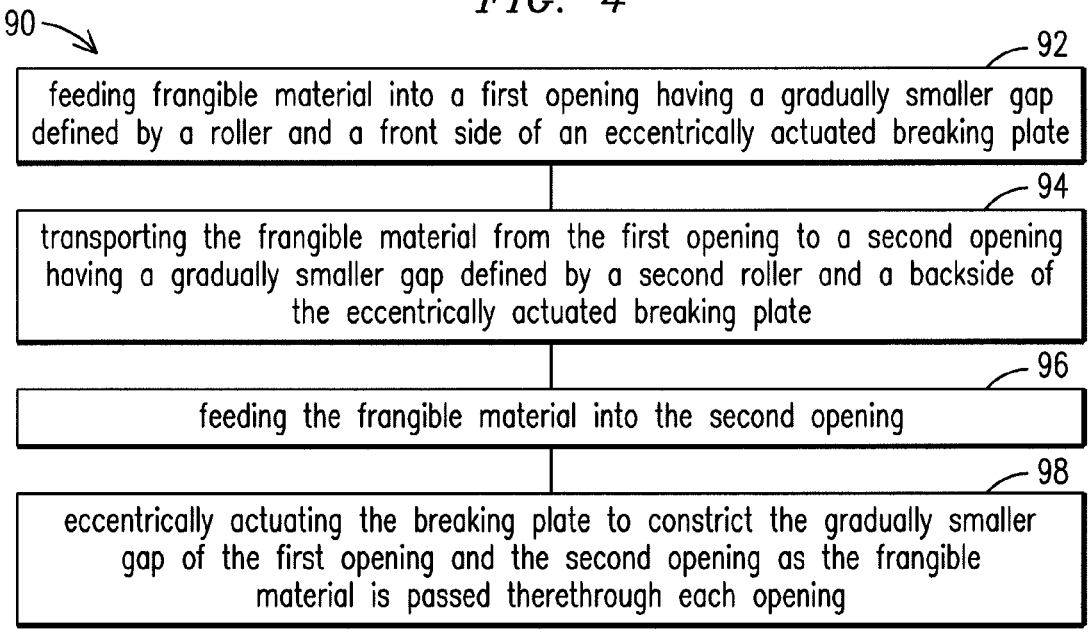
FIG. 5 discloses a flowchart illustrating another exemplary embodiment of a method for breaking frangible material.

FIG. 5 discloses a flowchart 90 illustrating another exemplary embodiment of a method for breaking frangible material. The method includes feeding frangible material into a first opening having a gradually smaller gap defined by a roller and a front side of an eccentrically actuated breaking plate, at 92. The frangible material is transported, and/or delivered, from the first opening to a second opening having a gradually smaller gap defined by a second roller and a backside of the eccentrically actuated breaking plate, at 94. The frangible material is fed into the second opening, at 96. The breaking plate is eccentrically actuated to constrict the gradually smaller gap of the first opening and the second opening as the frangible material is passed therethrough each opening, at 98.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What I claim is:

1. A roller jaw crusher system comprising:

an elongated roller that rotates normally about a center axis;

a movable breaking plate configured to define a gradually smaller gap between the breaking plate and the roller and to move during operation, independent of rotation of the elongated roller; and a driving connection connected to the movable breaking plate to cause the movable breaking plate to rise upward and descend in both a downward direction and a direction toward the elongated roller during operation;

wherein the movable breaking plate is configured to rise upward and descend in both a downward direction and a direction toward the elongated roller during operation to break a frangible material captured between the elongated roller and the movable breaking plate.

2. The roller jaw crusher system according to claim 1, further comprising a frame member upon which the elongated roller and the movable breaking plate are supported.

3. The roller jaw crusher system according to claim 2, wherein the movable breaking plate is mounted to the frame member with a sliding connection at an axle of the frame member to allow the movable breaking plate to rise upward and descend in both a downward direction and a direction toward the elongated roller during operation.

4. The roller jaw crusher system according to claim 3, wherein the sliding connection comprises a slotted opening through the movable breaking plate through which an axle connected to the frame member extends.

5. The roller jaw crusher system according to claim 1, wherein the driving connection comprises a cam roller fitted to the movable breaking plate wherein the cam roller is rotatable to cause the movable breaking plate to rise upward and descend in both a downward direction and a direction toward the elongated roller during operation.

6. The roller jaw crusher system according to claim 5, wherein the cam roller is connected to an eccentric drive system.

7. The roller jaw crusher system according to claim 1, wherein the elongated roller further comprises a plurality of teeth configured on an outer surface of the elongated roller.

8. The roller jaw crusher system according to claim 7, wherein the plurality of teeth are configured to catch and pull the frangible material through the elongated roller and the movable breaking plate and to aid in breaking the material into smaller pieces.

9. The roller jaw crusher system according to claim 7, wherein at least one tooth of the plurality of teeth comprises three bars wherein a first and second bar are connected to the outer surface of the elongated roller spaced apart just enough to receive the third bar which is rotated so that opposite corners of the third bar contact the first two bars.

10. The roller jaw crusher system according to claim 1, further comprising a motor connected in driving relationship to the elongated roller to effect rotation of the elongated roller about its axis.

11. A roller jaw crusher system comprising:

a first roller that rotates normally about a center axis;

a second roller that rotates normally about a center axis;

a movable breaking plate disposed between the first roller and the second roller and configured to move during operation, independent of rotation of the elongated rollers, the movable breaking plate having a front side facing the first roller and a back side facing the second roller, each side configured to define a gradually smaller gap between the breaking plate and each respective roller; and a conveyer system to deliver frangible material exiting from a first gradually smaller gap between the first roller and the movable breaking plate to a second gradually smaller gap between the breaking plate and the second roller;

wherein movement of the movable breaking plate results in breaking a frangible material disposed between the first roller and the movable breaking plate into broken pieces that are broken into smaller pieces when disposed between the second roller and the movable breaking plate.

12. The roller jaw crusher system according to claim 11, further comprising a frame member upon which the first roller, the second roller, and the movable breaking plate are supported.

13. The roller jaw crusher system according to claim 12, wherein the movable breaking plate is mounted to the frame member with a sliding connection at an axle of the frame member to allow eccentric movement by the movable breaking plate during operation.

14. The roller jaw crusher system according to claim 11, further comprising a driving connection connected to the movable breaking plate to allow eccentric movement by the movable breaking plate during operation.

15. The roller jaw crusher system according to claim 11, wherein the movable breaking plate is moved by an eccentric drive system.

16. A roller jaw crusher system comprising:

a frame member;

an elongated roller that rotates normally about a center axis and which is supported by the frame member;

an axle extending from the frame member; and a movable breaking plate having a slotted opening through which the axle is located forming a sliding connection, the movable breaking plate is configured to define a gradually smaller gap between the breaking plate and the roller and to move during operation independent of rotation of the elongated roller;

wherein the movable breaking plate is configured to rise upward and descend in both a downward direction and a direction toward the elongated roller during operation to break a frangible material captured between the elongated roller and the movable breaking plate.

17. The roller jaw crusher system according to claim 16, further comprising a driving connection connected to the movable breaking plate to cause the movable breaking plate to rise upward and descend in both a downward direction and a direction toward the elongated roller during operation.

18. The roller jaw crusher system according to claim 17, wherein the driving connection comprises a cam roller fitted to the movable breaking plate wherein the cam roller is rotatable to cause the movable breaking plate to rise upward and descend in both a downward direction and a direction toward the elongated roller during operation.

19. A roller jaw crusher system comprising:

a first roller that rotates normally about a center axis;

a second roller that rotates normally about a center axis;

a movable breaking plate disposed between the first roller and the second roller and configured to move during operation, independent of rotation of the elongated rollers, the movable breaking plate having a front side facing the first roller and a back side facing the second roller, each side configured to define a gradually smaller gap between the breaking plate and each respective roller and a slotted opening;

a frame member upon which the first roller, the second roller, and the movable breaking plate are supported;

an axle extending from the frame member upon which the movable breaking plate is mounted with the slotted opening to form a sliding connection;

a conveyer system to deliver frangible material exiting from a first gradually smaller gap between the first roller and the movable breaking plate to a second gradually smaller gap between the breaking plate and the second roller;

wherein movement of the movable breaking plate results in breaking a frangible material disposed between the first roller and the movable breaking plate into broken pieces that are broken into smaller pieces when disposed between the second roller and the movable breaking plate.

20. The roller jaw crusher system according to claim 19, wherein the sliding connection allows for eccentric movement by the movable breaking plate during operation.

21. The roller jaw crusher system according to claim 19, further comprising a driving connection connected to the movable breaking plate to allow eccentric movement by the movable breaking plate during operation.

22. The roller jaw crusher system according to claim 19, wherein the movable breaking plate is moved by an eccentric drive system.

* * * * *